US007950759B2

(12) United States Patent
Kim et al.

(10) Patent No.: US 7,950,759 B2
(45) Date of Patent: May 31, 2011

(54) OPERATING METHOD FOR INKJET HEAD

(75) Inventors: Young-Jae Kim, Suwon-si (KR); Jae-Woo Joung, Suwon-si (KR); Chang-Sung Park, Suwon-si (KR); Young-Seuck Yoo, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 109 days.

(21) Appl. No.: 11/730,881

(22) Filed: Apr. 4, 2007

(65) Prior Publication Data

US 2007/0257948 A1 Nov. 8, 2007

(30) Foreign Application Priority Data

Apr. 17, 2006 (KR) ..... 10-2006-0034450

(51) Int. Cl.
*B41J 29/38* (2006.01)

(52) U.S. Cl. ..... 347/10; 347/5; 347/11

(58) Field of Classification Search ..... 347/9–11, 347/5, 14

See application file for complete search history.

(56) References Cited

U.S. PATENT DOCUMENTS

| | | | | |
|---|---|---|---|---|
| 6,598,950 | B1 * | 7/2003 | Hosono et al. | 347/11 |
| 6,705,696 | B1 * | 3/2004 | Okuda et al. | 347/11 |
| 2007/0002091 | A1 * | 1/2007 | Kida et al. | 347/19 |

FOREIGN PATENT DOCUMENTS

| | | |
|---|---|---|
| JP | 2002-127418 | 5/2002 |
| JP | 2002-254632 | 9/2002 |
| JP | 2004-058300 | 2/2004 |
| JP | 2004-58300 | 2/2004 |

OTHER PUBLICATIONS

Japanese Office Action issued Oct. 22, 2009 in corresponding Japanese Patent Application 2007-107277.

Japanese Office Action dated Mar. 8, 2011, issued in Japanese Patent Application No. 2007-107277.

* cited by examiner

*Primary Examiner* — Lam S Nguyen

(57) ABSTRACT

A method of operating an inkjet head to eject ink droplets, for an inkjet head including a pressure chamber that is contracted and expanded in a particular period, including: decompression-operating the membrane, such that the volume of the pressure chamber is increased, in correspondence with the period in which the pressure chamber is expanded; compression-operating the membrane, such that the volume of the pressure chamber is decreased, in correspondence with the time point at which the pressure chamber is converted from an expanded state to a contracted state; decompression-operating the membrane, such that the volume of the pressure chamber is increased, in correspondence with the period in which the pressure chamber is contracted; and compression-operating the membrane, such that the volume of the pressure chamber is decreased, in correspondence with the time point at which the pressure chamber is converted from a contracted state to an expanded state.

74 Claims, 10 Drawing Sheets

OPERATING METHOD FOR INKJET HEAD

CROSS-REFERENCE TO RELATED APPLICATIONS

This application claims the benefit of Korean Patent Application No. 10-2006-0034450 filed with the Korean Intellectual Property Office on Apr. 17, 2006, the disclosure of which is incorporated herein by reference in its entirety.

BACKGROUND

1. Technical Field

The present invention relates to a method of operating an inkjet head.

2. Description of the Related Art

In an inkjet head, printing is performed by operating a membrane, which forms a part of a pressure and holds the ink in the pressure chamber, such that it compresses the pressure chamber, whereby ink droplets are ejected through nozzles connected to the pressure chamber.

The operation of the membrane is achieved by adjusting the voltage delivered to actuators joined to the membrane, where the series of operating signals, i.e. the form of operating waveform, transmitted to the actuators has a great impact on the size, the ejection speed, and stability of the ink droplets ejected. These ejection properties of the ink droplets may show different trends, even when actuators are operated by delivering the same operating waveforms, according to the internal structure of the inkjet head, shape of the actuators, size of the nozzles, and properties of the ink. Therefore, a method of maximizing the performance of an inkjet head would be to identify the properties of the inkjet head and then deliver an optimized waveform to the actuators.

FIGS. 1 to 3 are graphs illustrating operating waveforms for inkjet heads according to prior art. By delivering a pulse waveform once more at the final portion of the waveform, as shown in FIG. 1, to provide a smooth motion of the actuators, it is possible to efficiently suppress the vibration of the menisci and provide a stable ejection of ink droplets through a required diameter. However, this method is limited in that it considers only the relationship between the operating waveform and the resonance of the actuators.

In the approach shown in FIG. 2, the operating waveform is formed to correspond with the resonance period (Ta) of the actuators or the resonance period (Tc) of the pressure chamber, whereby the vibration of the menisci may be suppressed and the ejection of the ink droplets may be stabilized.

FIG. 3 shows an operating waveform with which both small and large droplets can be made in nozzles having a large diameter, to compensate for the fact that a small diameter of the nozzles, for improving disintegrating ability to provide minute ink droplets, slows down the speed, whereas a large diameter of the nozzles, for increasing speed, degrades the disintegrating ability.

However, the operating waveforms for inkjet heads described above do not provide a series of waveforms spanning the entire resonance period of the inkjet head that considers the respective resonance frequencies of the actuators, pressure chamber, and menisci, for ejecting ink droplets of a desired size at high speeds.

SUMMARY

An aspect of the present invention is to provide an operating method for an inkjet head, in which the operating waveform delivered to the actuators is configured using the resonance frequency of the inkjet head, whereby the size and speed of the ejected ink droplets can be adjusted, and stability is maintained even during high-frequency ejection.

A first aspect of the invention provides a method of operating an inkjet head to eject ink droplets, for an inkjet head including a pressure chamber that is contracted and expanded in a particular period, a membrane included in one side of the pressure chamber, and a nozzle connected to the pressure chamber, where the method includes: (a) decompression-operating the membrane, such that the volume of the pressure chamber is increased, in correspondence with the period in which the pressure chamber is expanded; (b) compression-operating the membrane, such that the volume of the pressure chamber is decreased, in correspondence with the time point at which the pressure chamber is converted from an expanded state to a contracted state; (c) decompression-operating the membrane, such that the volume of the pressure chamber is increased, in correspondence with the period in which the pressure chamber is contracted; and (d) compression-operating the membrane, such that the volume of the pressure chamber is decreased, in correspondence with the time point at which the pressure chamber is converted from a contracted state to an expanded state.

In another aspect of the invention, the membrane may be compression- or decompression-operated according to the period in which the meniscus of the ink droplet formed in the nozzle is imbibed to the inside of the nozzle or ejected to the outside of the nozzle, instead of the period in which the pressure chamber is expanded or contracted.

That is, a second aspect of the invention provides a method of operating an inkjet head to eject ink droplets, for an inkjet head including a pressure chamber, a membrane included in one side of the pressure chamber, and a nozzle connected to the pressure chamber and having a meniscus of an ink droplet formed therein, where the meniscus is ejected and imbibed in a particular period; where the method includes: (a) decompression-operating the membrane, such that the volume of the pressure chamber is increased, in correspondence with the period in which the meniscus is imbibed; (b) compression-operating the membrane, such that the volume of the pressure chamber is decreased, in correspondence with the time point at which the meniscus is converted from an imbibe state to an eject state; (c) decompression-operating the membrane, such that the volume of the pressure chamber is increased, in correspondence with the period in which the meniscus is ejected; and (d) compression-operating the membrane, such that the volume of the pressure chamber is decreased, in correspondence with the time point at which the meniscus is converted from an eject state to an imbibe state.

The process (b) may be performed such that the time point at which the pressure chamber is converted from an expanded state to a contracted state or the time point at which the meniscus is converted from an imbibe state to an eject state is included in the time duration in which the membrane is operated from a decompression state to a compression state, and it may also be desirable that the process be performed such that the time point at which the membrane is operated from a decompression state to a compression state coincides with the time point at which the pressure chamber is converted from an expanded state to a contracted state or the time point at which the meniscus is converted from an imbibe state to an eject state.

The process (c) may be performed such that the decompression-operation of the membrane is completed before the time point at which the pressure chamber is converted from a contracted state to an expanded state or the time point at which the meniscus is converted from an imbibe state to an eject state, and it may also be desirable that the operation of the membrane be stopped, so that the volume of the pressure chamber is maintained, between the process (c) and the process (d).

The process (d) may be performed such that the time point at which the pressure chamber is converted from a contracted state to an expanded state or the time point at which the meniscus is converted from an eject state to an imbibe state is included in the time duration in which the membrane is operated from a decompression state to a compression state. It may also be desirable that the process be performed such that the time point at which the membrane is operated from a decompression state to a compression state coincides with the time point at which the pressure chamber is converted from a contracted state to an expanded state or the time point at which the meniscus is converted from an eject state to an imbibe state.

After the process (d), it may be desirable to (e) decompression-operate the membrane to coincide with the time point at which the pressure chamber is converted from an expanded state to a contracted state or the time point at which the meniscus is converted from an imbibe state to an eject state, such that the volume of the pressure chamber becomes the initial value, and it may also be desirable to stop the operation of the membrane such that the volume of the pressure chamber is maintained, between the process (d) and the process (e).

It may be desirable that the time during which the membrane is compression- or decompression-operated be longer than the resonance period of the membrane. The method may further include (f) stopping the operation of the membrane such that the volume of the pressure chamber is maintained, between the process (a) and the process (b), where it may be desirable that the sum of the time consumed for the process (a) and the time consumed for the process (f) be equal to the time corresponding to one half of the resonance period.

It may be desirable to stop the operation of the membrane such that the volume of the pressure chamber is maintained, between the process (b) and the process (c). An actuator may be joined to the membrane, and the compression- or decompression-operation of the membrane may be performed by adjusting the value of the voltage delivered to the actuator.

These general and specific aspects of the invention may be practiced using any one of a system, method, and a recorded medium having a recorded computer program, or a combination thereof.

That is, a third aspect of the invention provides an inkjet recording device which includes: a pressure chamber contracted and expanded in a particular period; a membrane included in one side of the pressure chamber; an actuator, joined to the membrane, for operating the membrane such that the membrane compresses or decompresses the pressure chamber; a signal generation part for transmitting signals to the actuator; and a nozzle connected to the pressure chamber, where the signal generation part sequentially generates signals such that the method of operating an inkjet head according to the first aspect of the invention set forth above may be performed.

Also, a fourth aspect of the invention provides an inkjet recording device which includes: a pressure chamber; a membrane included in one side of the pressure chamber; an actuator, joined to the membrane, for operating the membrane such that the membrane compresses or decompresses the pressure chamber; a signal generation part for transmitting signals to the actuator; and a nozzle connected to the pressure chamber and having a meniscus of an ink droplet formed therein, where the meniscus is ejected and imbibed in a particular period, and where the signal generation part sequentially generates signals such that the method of operating an inkjet head according to the second aspect of the invention set forth above may be performed.

It may be desirable that the signals for decompression-operating the membrane have negative voltages, and that the signals for compression-operating the membrane have positive voltages.

A fifth aspect of the invention provides a recorded medium readable by an inkjet recording device, tangibly embodying a program of instructions executable by the inkjet recording device for performing a method of operating an inkjet head which includes a pressure chamber that is contracted and expanded in a particular period, a membrane included in one side of the pressure chamber, and a nozzle connected to the pressure chamber, so as to perform printing by ejecting ink droplets through the nozzle, where the program of instructions generate and output control signals that perform a method of operating an inkjet head according to the first aspect of the invention set forth above.

A sixth aspect of the invention provides a recorded medium readable by an inkjet recording device, tangibly embodying a program of instructions executable by the inkjet recording device for performing a method of printing by operating an inkjet head comprising a pressure chamber, a membrane included in one side of the pressure chamber, and a nozzle connected to the pressure chamber and having a meniscus of an ink droplet formed therein, where the meniscus being ejected and imbibed in a particular period, and where the program of instructions generate and output control signals that perform a method of operating an inkjet head according to the second aspect of the invention set forth above.

Additional aspects, features, and advantages of the present invention, besides those described above, will become apparent and more readily appreciated from the following description, including the appended drawings and claims, or may be learned by practice of the invention.

DETAILED DESCRIPTION

Embodiments of the invention will be described below in more detail with reference to the accompanying drawings. In the description with reference to the accompanying drawings, those components that are the same or are in correspondence are rendered the same reference number regardless of the figure number, and redundant explanations are omitted.

Figure 1:
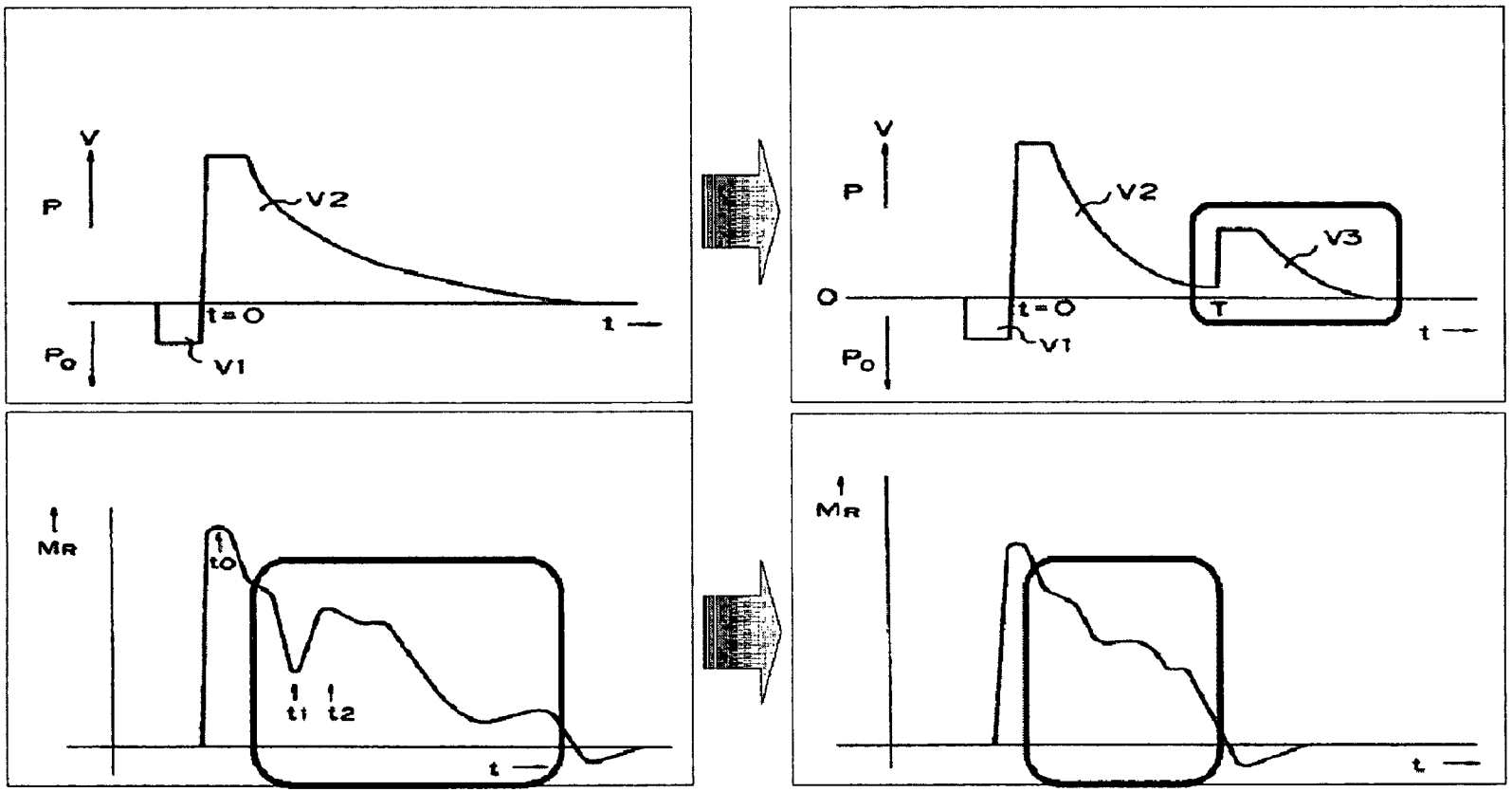
Prior Art FIG. 1
FIG. 1 is a graph illustrating an operating waveform for an inkjet head according to prior art.
Figure 2:
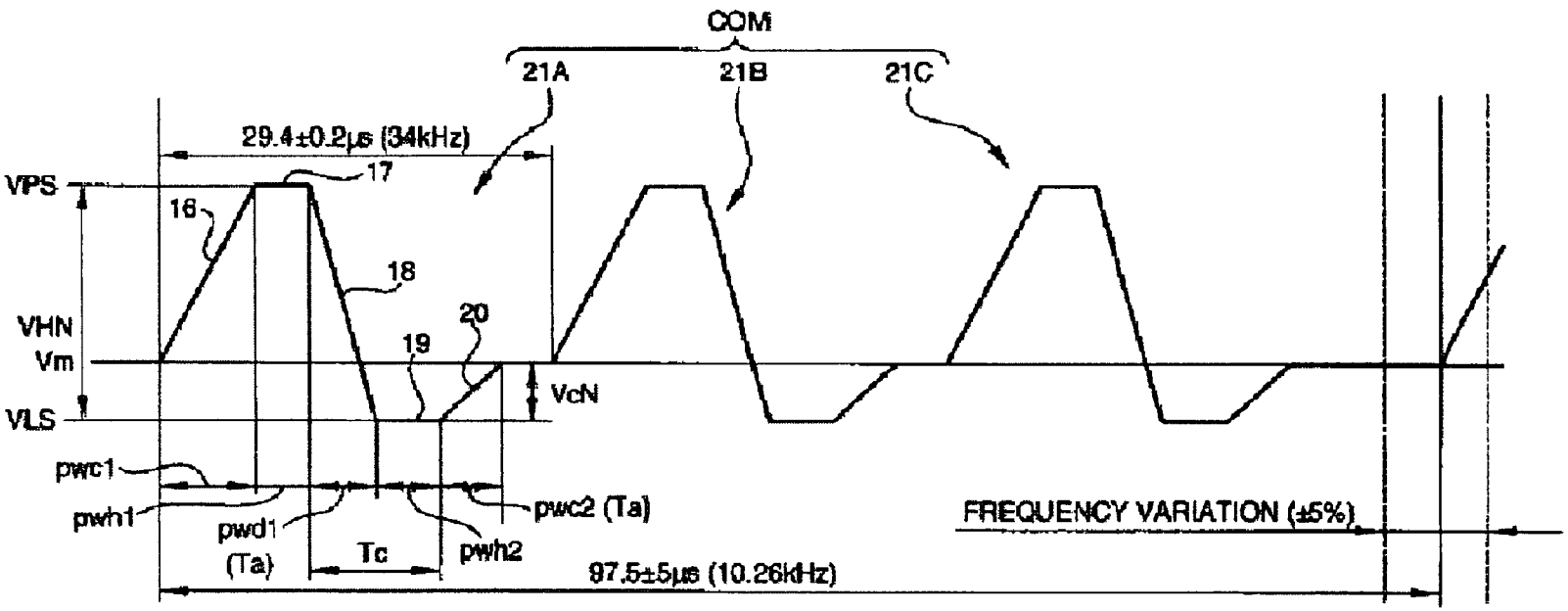
Prior Art FIG. 2
FIG. 2 is a graph illustrating an operating waveform for an inkjet head according to prior art.
Figure 3:
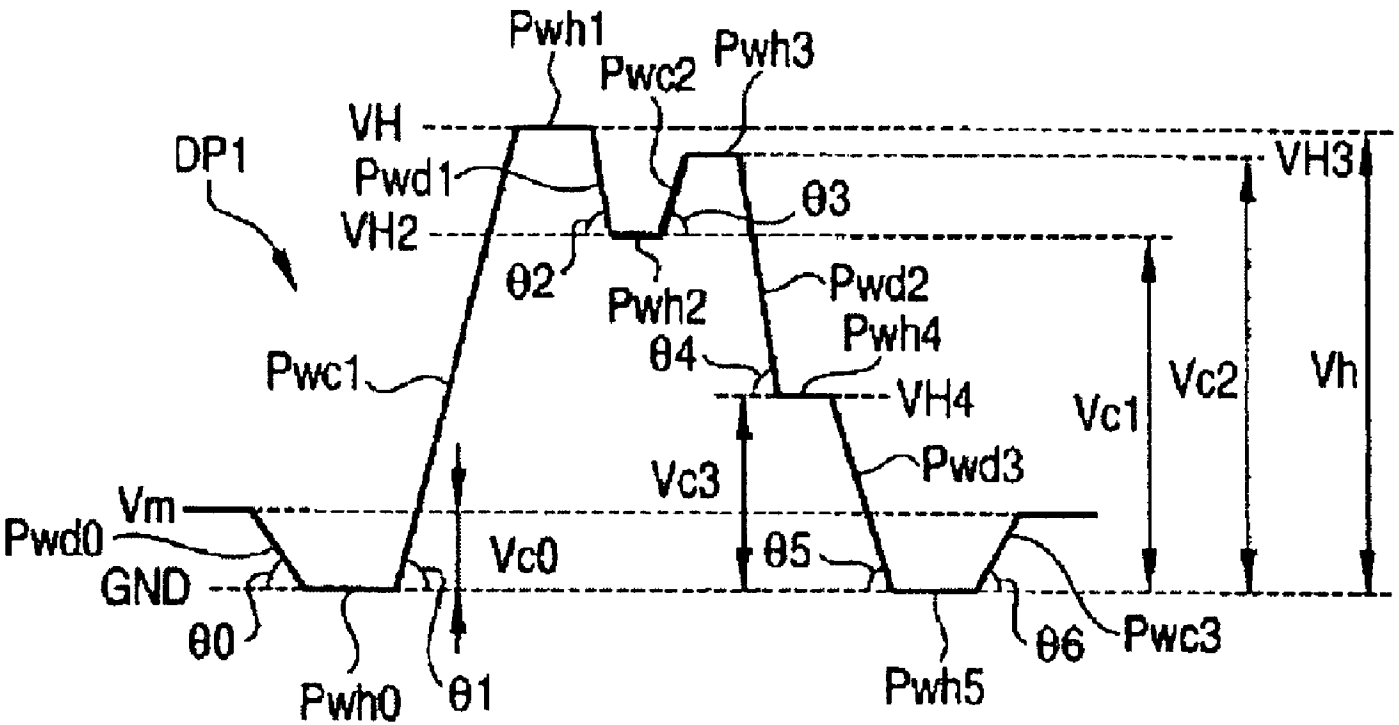
Prior Art FIG. 3
FIG. 3 is a graph illustrating an operating waveform for an inkjet head according to prior art.
Figure 4:
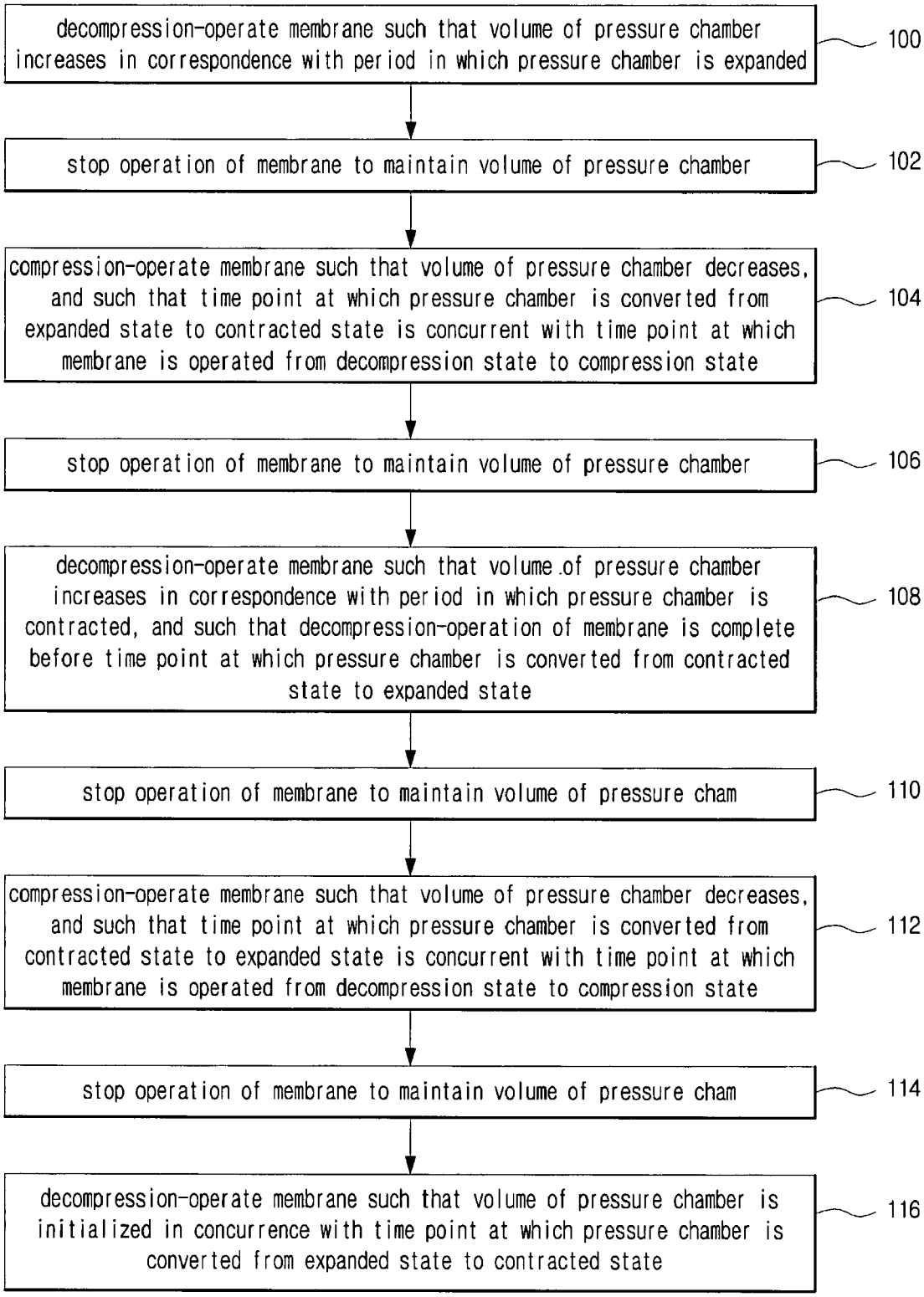
FIG. 4 is a flowchart illustrating a method of operating an inkjet head according to a first disclosed embodiment of the invention.
Figure 5:
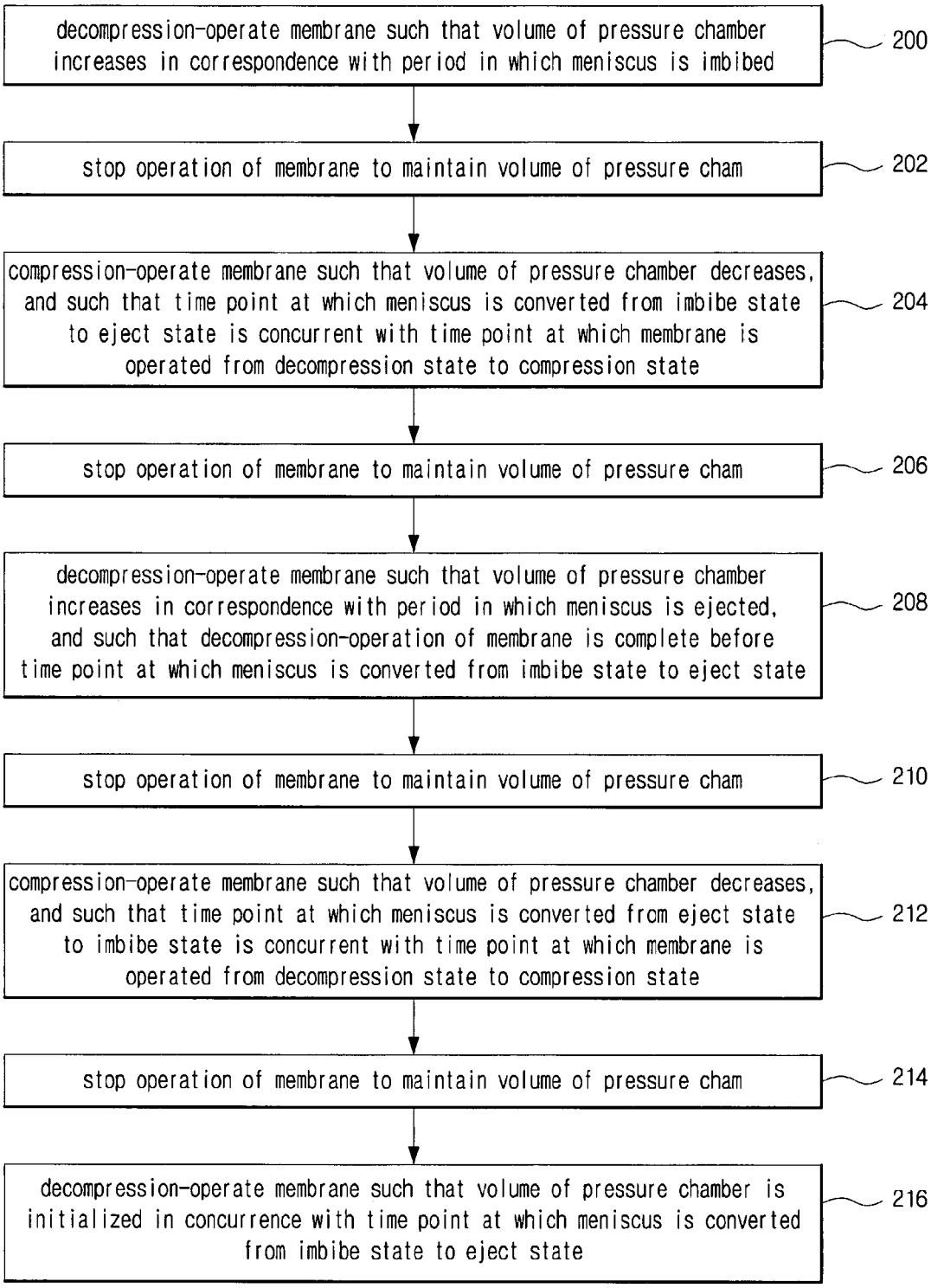
FIG. 5 is a flowchart illustrating a method of operating an inkjet head according to a second disclosed embodiment of the invention.
Figure 6:
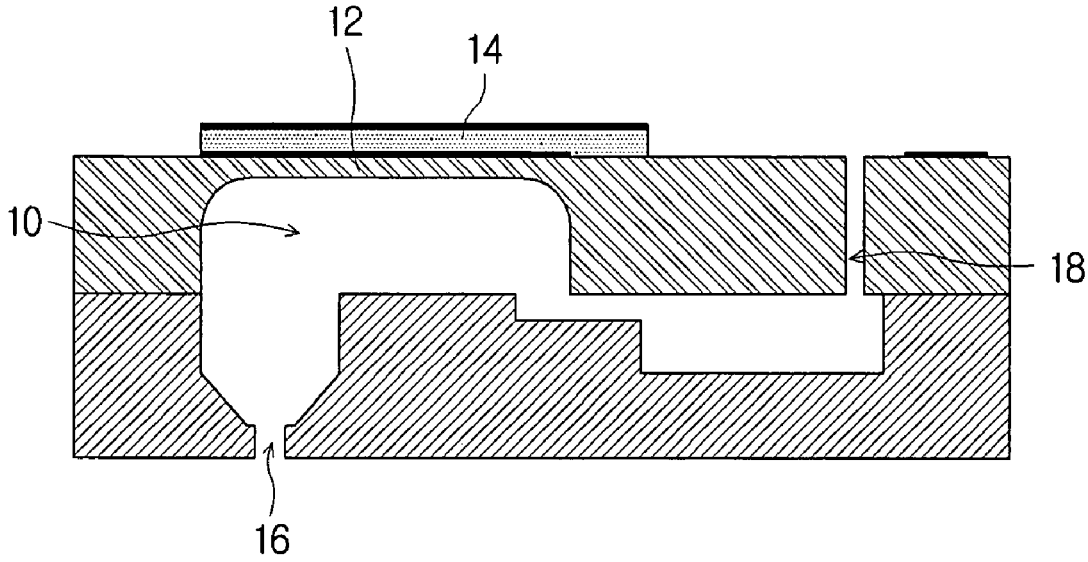
FIG. 6 is a cross-sectional view illustrating the structure of an inkjet head according to an embodiment of the invention.

FIG. 4 is a flowchart illustrating a method of operating an inkjet head according to a first disclosed embodiment of the invention, FIG. 5 is a flowchart illustrating a method of operating an inkjet head according to a second disclosed embodiment of the invention, and FIG. 6 is a cross-sectional view illustrating the structure of an inkjet head according to an embodiment of the invention. In FIG. 6 are illustrated a pressure chamber 10, membrane 12, actuator 14, nozzle 16, and an ink inlet 18.

This embodiment relates to a method of operating an inkjet head, for an inkjet head composed of a pressure chamber 10, a membrane 12 forming one side of the pressure chamber 10, and a nozzle 16 connected to the pressure chamber 10, where ink is supplied to the pressure chamber 10 through an ink inlet 18, and an operating signal is delivered to an actuator 14, which is joined to the membrane 12 to move as a single body, so as to operate the membrane 12, whereby an ink droplet is ejected through the nozzle 16.

When the operating signal is delivered to the actuator 14 to operate the membrane 12, the membrane 12 and the pressure chamber 10 are made to vibrate, each in its particular resonance period, and when the pressure chamber 10 is full of ink, the meniscus of the ink droplet formed at the end of the nozzle 16 is also made to vibrate in a particular resonance period. That is, the membrane 12 is vibrated in a particular resonance period to compress and decompress the pressure chamber 10, the pressure chamber 10 is vibrated in a particular resonance period to be contracted and expanded, and the meniscus is vibrated in a particular resonance period such that the ink droplet is ejected towards the nozzle 16 and imbibed to the inside of the nozzle 16.

In this embodiment, the waveform of the operating signals delivered to the actuator 14, i.e. the operating waveform, is designed in consideration of these resonance periods of the membrane 12, pressure chamber 10, and meniscus, so that ink droplets of a desired size may be ejected at high-speeds in a stable manner.

Meanwhile, with regards delivering an operating signal to the actuator 14, delivering a positive voltage, for example, deforms the actuator 14 towards the pressure chamber 10 such that the membrane 12 is operated in the direction of compressing the pressure chamber 10, while delivering a negative voltage deforms the actuator 14 in the direction opposite the pressure chamber 10 such that the membrane 12 is operated in the direction of decompressing the pressure chamber 10. Such operating forms of the membrane 12 will be referred to below in the detailed descriptions as "compression-operation" or "decompression-operation" of the membrane 12.

In the method of operating an inkjet head according to this embodiment, first, the membrane 12 is decompression-operated such that the volume of the pressure chamber 10 is increased (100). Considering the resonance period Tc of the pressure chamber 10, the membrane 12 is compression-operated, during the expansion of the pressure chamber 10, i.e. for a time corresponding to about one half of the resonance period of the pressure chamber 10. For this, it is desirable, after operating the membrane 12 for the particular amount of time, to stop the operation of the membrane 12 (102) such that the volume of the pressure chamber 10 is maintained in an expanded state. That is, the time during which the membrane 12 is decompression-operated and the membrane 12 is kept in a decompression-operated state, is equal to one half of the resonance period Tc of the pressure chamber 10.

By making the time for decompression-operating the membrane 12 longer than the resonance period of the actuator 14, i.e. the resonance period Ta of the membrane 12, the resonance of the membrane 12 is prevented from affecting the change in volume of the pressure chamber 10 or the operation of the membrane 12. This is because, if the time during which the membrane 12 is operated is shorter than the resonance period Ta, there may still be vibrations of the membrane 12 remaining, due to resonance, after the operation of the membrane 12 is complete, whereby unnecessary vibrations may be transferred to the pressure chamber 10. Thus operating the membrane 12 longer than the resonance period Ta of the membrane 12 applies generally to the decompression- or compression-operation of the membrane 12 described later.

Also, after decompression-operating the membrane 12, a uniform signal is delivered such that the membrane 12 is stopped in a decompression state, as described above, so that the vibration due to the resonance of the membrane 12 does not have an effect on the pressure chamber 10.

Next, the membrane 12 is compression-operated, at the time point at which the pressure chamber 10 is converted from an expanded state to a contracted state according to the resonance period of the pressure chamber 10, so that the membrane 12 stopped in a decompression state is put into a compression state and the volume of the pressure chamber 10 is decreased (104). That is, a constructive interference is created between the operating waveform of the membrane 12 and the resonance waveform of the pressure chamber 10. This is achieved by converting the negative voltage previously delivered to the actuator 14 into a positive voltage. In this way, ink droplets may be ejected through the nozzle 16.

In order to maximize the ejection speed of the ink droplets, it is desirable to compression-operate the decompression-operated membrane 12, such that the time point at which the pressure chamber 10 is converted from an expanded state to a contracted state coincides with the time point at which the membrane 12 is converted from a decompression state to a compression state. However, when considering the size of the ink droplets and stability of ejection, etc., as opposed to considering only the ejection speed of the ink droplets, it is desirable to operate the membrane 12 in correspondence with the resonance period of the pressure chamber 10, such as by starting the compression-operation of the membrane 12 at the time point at which the pressure chamber 10 is converted from an expanded state to a compressed state, or by compression-operating the membrane 12 beforehand so that the compression-operation of the membrane 12 is completed at the time point at which the pressure chamber 10 is converted from an expanded state to a contracted state, etc.

After the ink droplet is ejected, the operation of the membrane 12 is stopped for a particular amount of time, such that the pressure chamber 10 maintains its volume in a contracted state (106). To "stop the operation of the membrane 12" refers to fixing the membrane 12 such that it is immobile, by maintaining a constant magnitude for the voltage delivered to the actuator 14. This is to prevent the vibrations due to the resonance of the inkjet head structure, such as the membrane 12 and pressure chamber 10, etc., from affecting the ejection of the ink droplets.

Next, the membrane 12 is decompression-operated while the pressure chamber 10 is contracted, such that the volume of the pressure chamber 10 is increased (108). The decompression-operation is made to be completed before the time point at which the pressure chamber 10, after being contracted, is converted again to an expansion state. This is to operate the membrane 12 in a decompression state beforehand, in order to compression-operate the membrane 12 again in accordance with the time point at which the pressure chamber 10 is converted to an expanded state, as will be described in more detail below.

After the membrane 12 is decompression-operated, it is fixed in a stop state, so that the volume of the pressure chamber 10 is not changed and is maintained constant (110). This is to prevent the vibrations due to the resonance of the inkjet head structure from affecting the pressure chamber 10, etc., as described above.

With the membrane 12 prepared in a decompression-operated state, the membrane 12 is compression-operated so that the volume of the pressure chamber 10 is decreased, in correspondence with the time point at which the pressure chamber 10 is converted from a contracted state to an expanded state according to the resonance period (112). That is, a destructive interference is created between the operating waveform of the membrane 12 and the resonance waveform of the pressure chamber 10. This is a process of offsetting the force of the pressure chamber 10 expanding due to resonance and the force of the membrane 12 compressing the pressure chamber 10 due to operation, which results in a second ink droplet being slightly ejected at the portion of the nozzle 16 and then returning back inside the nozzle 16.

In the first compression-operation of the membrane 12, at the same time an ink droplet is ejected out of the nozzle 16, a corresponding "tail" portion of the ink droplet is merged with the ink droplet, so that consequently the size of the ink droplet is increased. However, when a second process of compression-operating the membrane 12 is added, the ink droplet, which is ejected slightly and then returns inside the nozzle 16, catches the "tail" portion of the first ejected ink droplet and then returns back inside the nozzle 16, whereby the first ejected ink droplet maintains the size it had at the time of ejection. That is, the size of the ink droplet can be minutely controlled.

In order to minimize the size of the ink droplet, it is desirable that the decompression-operated membrane 12 be compression-operated such that the time point at which the pressure chamber 10 is converted from a contracted state to an expanded state is concurrent with the time point at which the membrane 12 is operated from a decompression state to a compression state. However, for flexible control of the size of the ink droplet, it is desirable to operate the membrane 12 in correspondence with the resonance period of the pressure chamber 10, such as by starting the compression-operation of the membrane 12 at the time point at which the pressure chamber 10 is converted from a contracted state to an expanded state, or by compression-operating the membrane 12 beforehand such that the compression-operation of the membrane 12 is completed at the time point at which the pressure chamber 10 is converted from a contracted state to an expanded state, etc.

As described above, it is desirable, after the compression-operation of the membrane 12 is complete, to stop the operation of the membrane 12 such that the volume of the pressure chamber 10 is maintained (114). After thus operating the membrane 12 in correspondence with the resonance period of the pressure chamber 10, to prepare for subsequent ejection, the membrane 12 is decompression-operated in concurrence with the time point at which the pressure chamber 10 is converted from an expanded state to a contracted state such that the volume of the pressure chamber 10 is returned to the initial state (116). This is a process not of ejecting an ink droplet, but of recovering the membrane 12 to its initial state within the necessary range, for stable movement of the inkjet head structure.

In the second disclosed embodiment illustrated in FIG. 5, the membrane 12 is compression- or decompression-operated in correspondence with the resonance period of the meniscus of the ink droplet formed in the nozzle 16, instead of the resonance period of the pressure chamber 10.

That is, the second disclosed embodiment relates to a method of operating an inkjet head, which is composed of a pressure chamber 10, a membrane 12 forming one side of the pressure chamber 10, and a nozzle 16 connected to the pressure chamber 10, where the operating waveform delivered to the actuator 14 joined to the membrane 12 is designed in consideration of the resonance period in which the meniscus of the ink droplet formed at the opening of the nozzle 16 is imbibed and ejected in and out of the nozzle 16, such that the waveform is in correspondence with the resonance period.

In the second disclosed embodiment, the inkjet head is operated by the same processes as those of the first disclosed embodiment, with the difference that the determining of whether to perform decompression- or compression-operation and of the operating time point of the membrane 12 are made to be in correspondence with the resonance period of the meniscus formed at the opening of the nozzle 16 and the time point at which the meniscus is converted from an eject/imbibe state to an imbibe/eject state, instead of the resonance period of the pressure chamber 10 and the time point at which the pressure chamber 10 is converted from an expanded/contracted state to a contracted/expanded state.

Methods of measuring the resonance period of the meniscus include irradiating a laser onto the portion of the nozzle 16 of the inkjet head, photographing with a stroboscope, and analyzing the obtained image, etc. Such methods are apparent to those skilled in the art, and thus detailed descriptions will not be provided on this matter.

Figure 7:
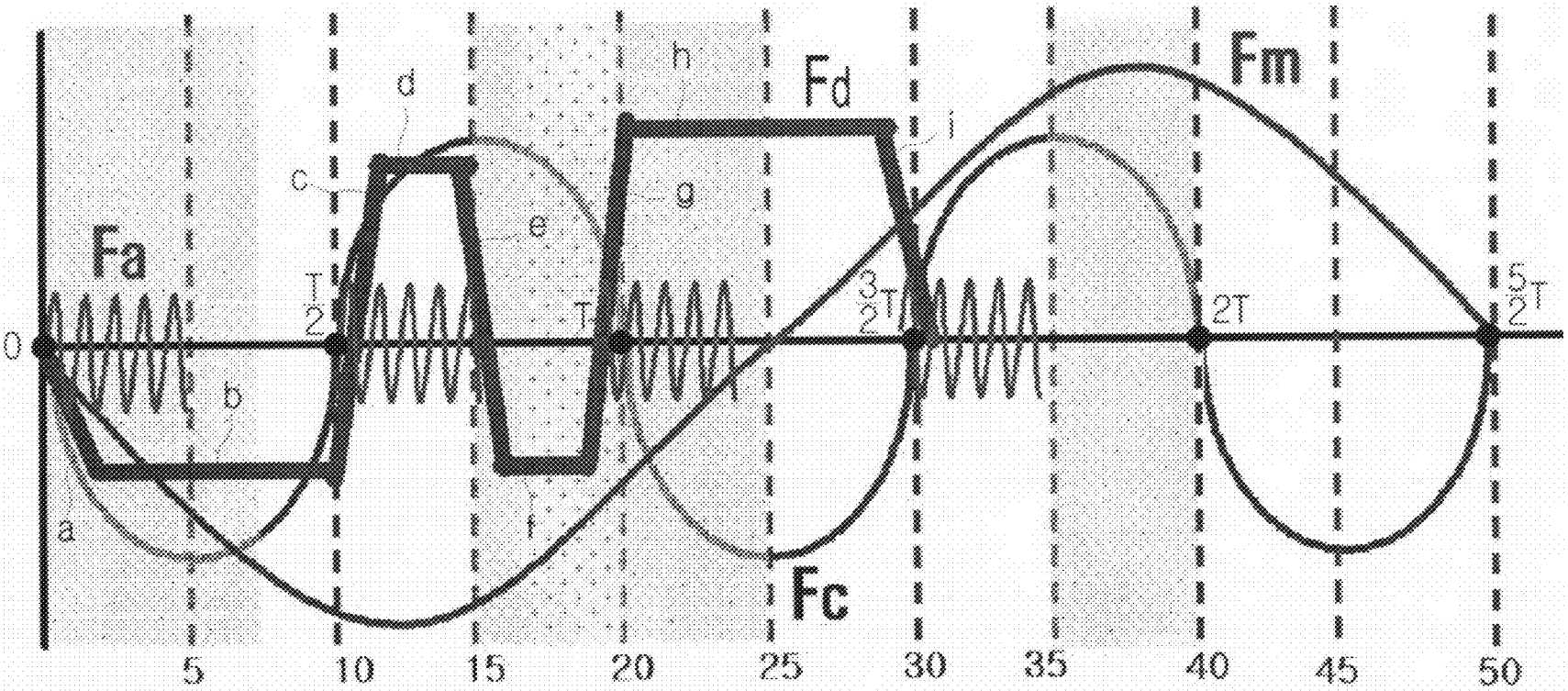
FIG. 7 is a graph illustrating an operating waveform for an inkjet head according to an embodiment of the invention.

FIG. 7 is a graph illustrating an operating waveform for an inkjet head according to an embodiment of the invention. In FIG. 7 are illustrated an operating waveform Fd, the resonance waveform Fa of the actuator, the resonance waveform Fc of the pressure chamber, and the resonance waveform Fm of the meniscus.

As illustrated in FIG. 7, during the ejection process of an ink droplet, three types of resonance are created in the inkjet head, the resonance of the actuator 14 and membrane 12, the resonance of the pressure chamber 10, and the resonance of the meniscus. The resonance waveform Fa of the actuator 14 represents a self-occurring resonance that is created when the actuator 14 is operated, while the resonance waveform Fc of the pressure chamber represents the resonance of the pressure chamber 10 that is created according to the operation of the membrane 12, which is determined by factors such as the properties of the ink held in the pressure chamber 10, the mechanical structure of the pressure chamber 10, and the structure of the actuator 14 joined to the membrane 12. The resonance waveform Fm of the meniscus represents the resonance of the meniscus of the ink droplet formed at the opening of the nozzle 16 in contact with air, created according to the operation of the membrane 12.

In this embodiment, the series of operating signals delivered to the actuator 14, i.e. the operating waveform Fd, is designed to correspond with these resonance waveforms of the inkjet head, and to match the resonance waveforms, they are illustrated in FIG. 7 along with the operating waveform Fd. However, in FIG. 7, different units are used for the y-axis of the graphs of the resonance waveforms Fa, Fc, Fm of the inkjet head and for the y-axis for the operating waveform Fd.

When operating signals are delivered to the actuator 14 joined to the membrane 12, the actuator 14 and membrane 12 are first made to resonate in a particular period, which causes the pressure chamber 10 holding ink within to resonate in a particular period, which in turn causes the meniscus of the ink droplet formed at the opening of the nozzle 16 to resonate in a particular period. On the basis that, since the vibration source creating the resonance is the actuator 14, the resonance period of the actuator is the shortest and the resonance period of the meniscus is the longest, the resonance waveforms are as schematically illustrated in FIG. 7.

Describing the method of operating an inkjet head according to the first disclosed embodiment set forth above, with reference to FIG. 7, the membrane 12 is first decompression-operated to increase the volume of the pressure chamber 10, for a length of time longer than the resonance period of the actuator 14, such as in section "a" of the operating waveform Fd. Next, the membrane 12 is stopped, as in section "b" of the operating waveform Fd, such that the volume of the pressure chamber 10 is maintained. The "a" and "b" sections last during the period in which the pressure chamber 10 is expanded, and thus it is desirable to configure the times for the "a" and "b" sections to correspond to a half of the resonance period of the pressure chamber 10.

Next, as in section "c" of the operating waveform Fd, the membrane 12 is compression-operated in accordance with the time point at which the pressure chamber 10 is converted from an expanded state to a contracted state. By thus compression-operating the membrane 12 in correspondence with the resonance of the pressure chamber 10, the speed by which the ink droplets are ejected may be maximized. Of course, as described above, the time point for compression-operating the membrane 12 does not necessarily have to coincide with the time point at which the pressure chamber 10 is converted from an expanded state to a contracted state, such that the section "c" meets the "T/2" point, and it is desirable to design the position and slope of the section "c" to correspond with the "T/2" point in consideration of the size of the ink droplets and stability of ejection, etc., by having the starting point or end point of section "c" coincide with the "T/2" point.

Meanwhile, as has been described above, it is desirable to configure the duration of the section "c" to be longer than the period of the actuator 14, in order to eliminate the effects of the resonance of the actuator 14.

After compression-operating the membrane 12 in concurrence with the time point at which the pressure chamber 10 is contracted, the membrane 12 is decompression-operated again, as in section "e" of the operating waveform Fd, to prepare the membrane 12 for compression-operation at point "T". After compression- or decompression-operating the membrane 12, a constant magnitude of voltage is delivered, such that the membrane 12 is stopped in a compression or decompression state, as in sections "d" and "f" of the operating waveform Fd, in order to suppress any unnecessary vibrations due to the resonance of the actuator 14.

Next, the membrane 12 is compression-operated as in section "g", to coincide with point "T", which is the time point at which the pressure chamber 10 is converted from a contracted state to an expanded state. As the compression-operation of the membrane 12 and the expansion of the pressure chamber 10 are offset by each other, a second ink droplet is ejected slightly out of the nozzle 16 and then imbibed back inside, which catches the "tail" portion of the first ink droplet and draws it inside the nozzle 16, contributing to the forming of a minute size for the first ink droplet.

Similar to the relationship between the section "c" of the operating waveform Fd and point "T/2", the relationship between section "g" of the operating waveform Fd and point "T" may be designed in a variety of ways according to the required ink droplet ejection performance. The compression-operated membrane 12 maintains a compressed state as in section "h", and then returns to the initial state in concurrence with the time point at which the expanded pressure chamber 10 is converted again to a contracted state. That is, the end point of section "i" of the operating waveform Fd is made to meet the "3T/2" point. Thus, one period of the operating waveform Fd is completed for ejecting an ink droplet according to this embodiment, and preparations are complete for subsequent ejection.

As illustrated in FIG. 7, the sections "a, c, e, g, i", in which the membrane 12 is operated, generate resonance in the actuator 14, and as described above, in order to eliminate the effects of unnecessary vibrations due to the resonance of the actuator 14, it is desirable to configure all of the times consumed for the above sections to be longer than the resonance period of the actuator 14.

While the operating waveform Fd of FIG. 7 is designed based on the resonance waveform of the pressure chamber 10, it is to be appreciated that the operating waveform Fd may also be designed based on the resonance waveform Fm of the meniscus illustrated in FIG. 7.

Figure 8:
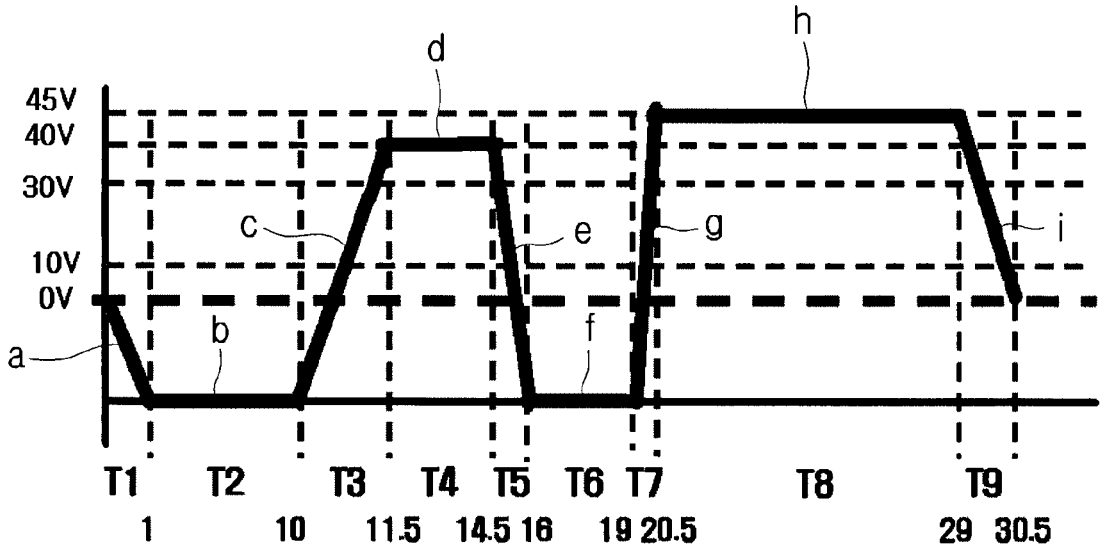
FIG. 8 is a graph illustrating the graph of FIG. 7 with numerical representations.

FIG. 8 is a graph illustrating the graph of FIG. 7 with numerical representations. In FIG. 8, the portions of the operating waveform Fd from FIG. 7 are illustrated separately, where the x-axis represents time, and the y-axis represents operating voltage. Since the resonance of the actuator 14 inhibits the stable ejection of ink droplets by transferring unnecessary vibrations to the head structure, damping this as much as possible is advantageous to high-frequency ejection. Therefore, it is desirable that the sections "T1, T3, T5, T7, T9" of FIG. 8 maintain integer multiples of the resonance period Ta of the actuator 14.

In particular, since section "T3" is a section in which an ink droplet is ejected, it is desirable that the membrane 12 be compressed in as short a time as possible in order to eject the ink droplet in a fast speed, and therefore, it is desirable to design the section "T3" to be equal to the resonance period Ta of the actuator 14.

It is desirable, in sections "T2, T6" for stopping the membrane 12 in a decompression-operated state, to make it so that constant negative voltages are maintained. As described above, it is desirable that sections "T1" and "T2", which are sections where the membrane 12 is initially decompression-operated in preparation for ink droplet ejection, correspond to half the resonance period Tc of the pressure chamber, and thus the speed of the ink droplets ejected may be maximized when designing "T2" as "(Tc/2)−T1".

It is desirable that section "T4" maintain a constant voltage, so that the effects of the operation of the actuator 14 may sufficiently be reflected in the pressure chamber 10, etc.

Meanwhile, in order to minimize the size of the ink droplet, instead of maximizing the ejection speed of the ink droplet, it is desirable to match the value of "T1+T2" in FIG. 8 with 12.5 usec, at which the resonance waveform Fm of the meniscus has the lowest value in FIG. 7. That is, the membrane 12 is compression-operated so that an ink droplet is ejected, when the meniscus is in its most contracted state.

In section "T5", the pressure is reduced inside the pressure chamber 10 by decompression-operating the membrane 12, whereby the ink droplet being ejected is imbibed and the size of the ink droplet is decreased. Therefore, it is desirable to operate the membrane 12 rapidly, and as described above, to design the section to be equal to the resonance period Ta of the actuator 14.

In section "T6", it is desirable that a negative voltage be maintained for a certain amount of time, in order to maximize the effect of section "T5" and to allow the membrane 12 to reach the maximum displacement.

As section "T7" is the portion where the second ink droplet is slightly ejected and then catches the "tail" portion of the first ink droplet to go back inside the pressure chamber 10, it is configured to generate destructive interference with the resonance waveform of the pressure chamber 10, as described above with reference to FIG. 7. If this condition is not met, the second ink droplet is not returned inside the pressure chamber 10 but is ejected together with the first droplet, for a disadvantageous effect on minute droplet ejection, as will be described below with reference to FIG. 10.

Sections "T8" and "T9" are sections in which the membrane 12 is initialized to prepare for subsequent ejection, as described above, for which it is desirable that the end point of "T9" be configured to coincide with the resonance period of the pressure chamber 10.

Figure 9:
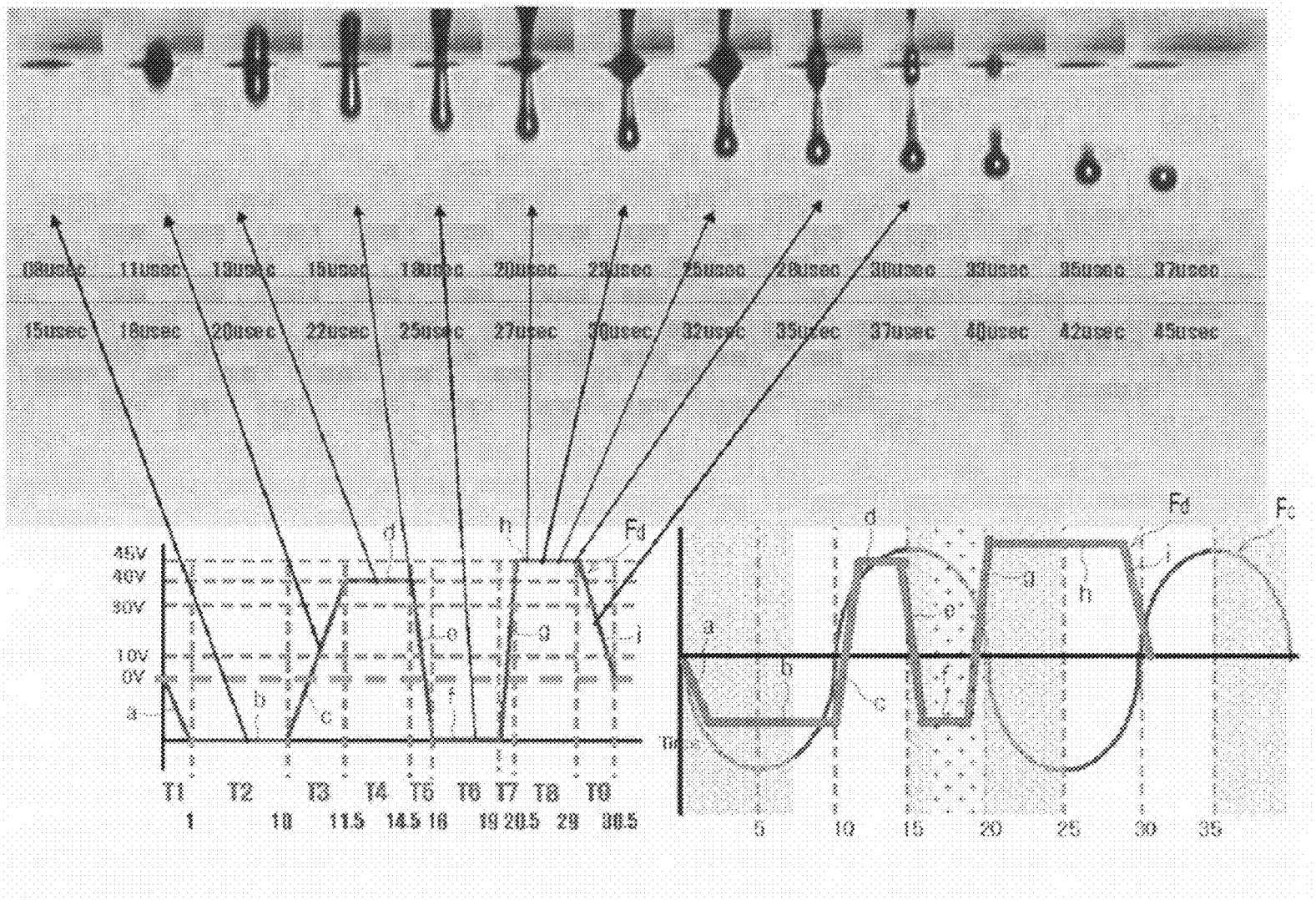
FIG. 9 is a diagram comparing the graphs illustrated in FIG. 7 and FIG. 8 with an ejection process of an ink droplet.

FIG. 9 is a diagram comparing the graphs illustrated in FIG. 7 and FIG. 8 with an ejection process of an ink droplet, in which each section of the operating waveform illustrated in FIGS. 7 and 8 is put in correspondence with a photograph of the ejection state an ink droplet ejected from the nozzle 16 of an inkjet head.

As illustrated in FIG. 9, the starting point of section "T3" is configured to generate constructive interference with the resonance waveform of the pressure chamber 10, and the "T4" section is maintained, after which the membrane 12 is decompression-operated again in section "T5" to prepare for the second compression-operation, and the section "T6" is maintained, after which section "T7" is configured to generate destructive interference with the resonance waveform of the pressure chamber 10.

The degree to which the membrane 12 is compressed in section "T7" is determined by the voltage value configured at the end point of section "T7", i.e. at section "T8", and therefore, by adjusting the configured voltage of section "T8", the degree to which the second droplet is ejected can be regulated to maximize the effect of minute droplet ejection. Meanwhile, by configuring the starting point of section "T9", in which the membrane 12 is decompression-operated to initialize the membrane 12, such that destructive interference is created with the resonance period of the pressure chamber 10, damping may be achieved on vibrations due to the resonance of the pressure chamber 10, whereby the unstable ejection of ink droplets may be prevented beforehand and high-frequency ejection may be achieved.

Figure 10:
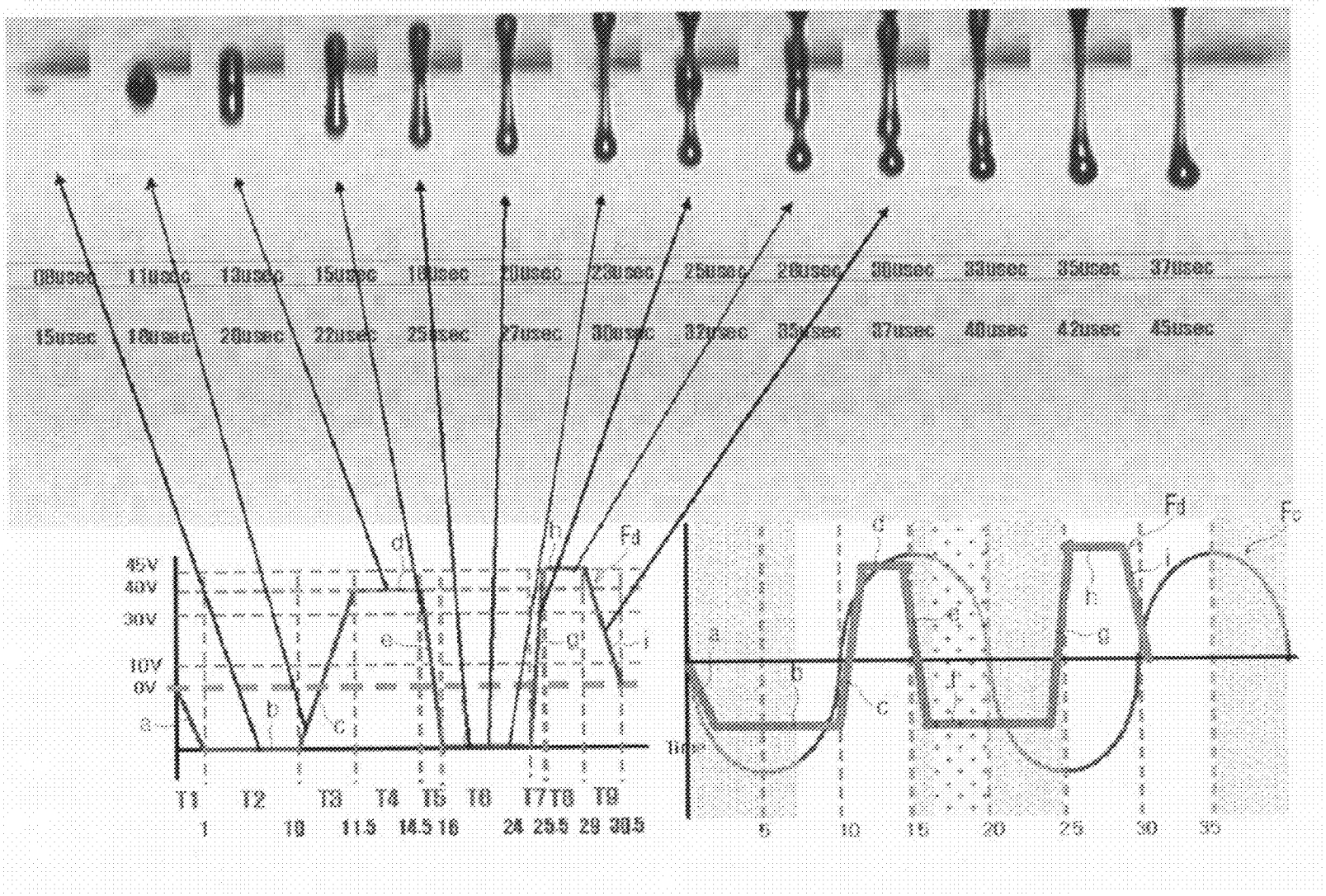
FIG. 10 is a diagram comparing an operating waveform for an inkjet head with an ejection process of an ink droplet, according to another embodiment of the invention.

FIG. 10 is a diagram comparing an operating waveform for an inkjet head with an ejection process of an ink droplet, according to another embodiment of the invention. In FIG. 10, each section of the operating waveform is illustrated in correspondence with a photograph of the ejection state of an ink droplet ejected from the nozzle 16 of an inkjet head, with the "f" section of the operating waveform illustrated in FIGS. 7 and 8 configured differently from the embodiment described above.

As opposed to FIG. 9, FIG. 10 shows the ejection process of an ink droplet in the case where the length of section "T6" has been configured differently such that the section "T7" does not generate destructive interference with the resonance waveform of the pressure chamber 10.

That is, since destructive interference with the resonance waveform of the pressure chamber 10 is not generated in section "T7", the second ink droplet ejected due to the compression-operation of the membrane 12 does not catch the "tail" portion of the first ejected ink droplet to return inside the pressure chamber 10, but instead is ejected out of the nozzle 16 to be ejected and combined together with the first ink droplet. This operating waveform for the actuator 14 has an adverse effect on the ejection of minute droplets. Thus, it is seen that the position where section "T7" overlaps the resonance waveform of the pressure chamber 10 for constructive or destructive interference has a great effect on the ejection of minute droplets.

Therefore, the ink droplets ejected can be adjusted to have a variety of sizes by regulating the position where section "T7" overlaps the resonance waveform of the pressure chamber or the meniscus, which may be used in printing grayscale images, etc.

As in this embodiment, the ejection speed of ink droplet may be maximized by having the signal, which compression-operates the membrane 12 to eject ink droplets, to form a constructive interference with the resonance waveform of the pressure chamber 10, while the ink droplet can be adjusted to have a minute size by compression-operating the membrane 12 after the ejection of the first ink droplet to form a destructive interference with the resonance waveform of the pressure chamber 10.

This method of operating an inkjet head may be used in a printing process performed through an inkjet recording device, and furthermore may be used in calibrating an inkjet head, when coordinating the uniformity of nozzles in an inkjet head having a plurality of nozzles, by adjusting the position of each nozzle with respect to the resonance waveform of the pressure chamber or the meniscus.

The method of operating an inkjet head described above may be used in an inkjet recording device that uses an inkjet head for printing. That is, an inkjet recording device may be implemented according to this embodiment, which performs printing using an inkjet head composed of a pressure chamber 10 that is contracted and expanded in a particular resonance period, a membrane 12 forming one side of the pressure chamber 10, an actuator 14 joined to the membrane 12 such that the membrane 12 compresses or decompresses the pressure chamber 10, and a nozzle 16 connected to the pressure chamber 10, and in which signals are generated in a signal generation part electrically connected to the actuator 14, which enable the method of operating an inkjet head according to the first and second embodiments described above, and sequentially delivered to the actuator 14.

Meanwhile, this method of operating an inkjet head may be stored in the form of a program in the inkjet recording device or in a computer recorded medium connected thereto, where such a program may be installed in the inkjet recording device itself or may be used in the form of a printer driver file in a computer to which the recording device is connected, to improve the ejection speed of ink droplets and allow minute sizes of ink droplets in a previously installed inkjet recording device.

That is, in an inkjet recording device that ejects ink droplets to perform printing, using an inkjet head composed of a pressure chamber 10 that is contracted and expanded in a particular resonance period, a membrane 12 forming one side of the pressure chamber 10, and a nozzle 16 connected to the pressure chamber 10, the signals delivered during the printing from a controller to the actuator 14 joined to the membrane 12 of the inkjet head are configured as the operating waveform according to this embodiment. This embodiment may also be implemented in the form of a recorded medium tangibly recording a program of instructions, which can be installed in the inkjet recording device itself or installed as a driver file in a computer to which the inkjet recording device is connected, and which can be read by the inkjet recording device to be executed while the inkjet recording device performs printing.

The program of instructions is a program that is written such that the method of operating an inkjet head according to the first and second disclosed embodiments described above is executed in sequence. The program may be stored by means of a storage medium, network, or the Internet, etc., in an inkjet recording device or a computer connected thereto, after which it may be read by the inkjet recording device in the process of printing using the inkjet recording device.

According to certain embodiments of the invention as set forth above, the operating waveform delivered to the actuator is designed in consideration of all of the resonance frequencies of the actuator, pressure chamber, and meniscus, whereby the ejection speed of ink droplets may be increased and the size of the ink droplets may be minimized, without being subject to the effects of resonance of the actuator during the process of ejecting the ink droplets.

While the present invention has been described with reference to particular embodiments, it is to be appreciated that various changes and modifications may be made by those skilled in the art without departing from the spirit and scope of the present invention, as defined by the appended claims and their equivalents.

What is claimed is:

1. A method of operating an inkjet head to eject an ink droplet, wherein the inkjet head comprises a pressure chamber that is contracted and expanded in a particular period, a membrane included in one side of the pressure chamber, and a nozzle connected to the pressure chamber, the method comprising:

(a) decompression-operating the membrane such that the volume of the pressure chamber is increased in correspondence with the period in which the pressure chamber is expanded;

(b) compression-operating the membrane to eject a first ink droplet such that the volume of the pressure chamber is decreased in correspondence with the time point at which the pressure chamber is converted from an expanded state to a contracted state and a constructive interference is created;

(c) decompression-operating the membrane such that the volume of the pressure chamber is increased in correspondence with the period in which the pressure chamber is contracted; and (d) compression-operating the membrane to eject a second ink droplet such that the volume of the pressure chamber is decreased in correspondence with the time point at which the pressure chamber is converted from a contracted state to an expanded state and a destructive interference is created, wherein the second ink droplet is ejected slightly out of the nozzle and then imbibed back inside, such that the second ink droplet catches a tail portion of the first ink droplet and draws the tail portion inside the nozzle.

2. The method of claim 1, wherein the process (b) is performed such that the time point at which the pressure chamber is converted from an expanded state to a contracted state is included in the time duration in which the membrane is operated from a decompression state to a compression state.

3. The method of claim 2, wherein the process (b) is performed such that the time point at which the membrane is operated from a decompression state to a compression state coincides with the time point at which the pressure chamber is converted from an expanded state to a contracted state.

4. The method of claim 1, wherein the process (c) is performed such that the decompression-operation of the membrane is completed before the time point at which the pressure chamber is converted from a contracted state to an expanded state.

5. The method of claim 4, further comprising stopping the operation of the membrane such that the volume of the pressure chamber is maintained, between the process (c) and the process (d).

6. The method of claim 1, wherein the process (d) is performed such that the time point at which the pressure chamber is converted from a contracted state to an expanded state is included in the time duration in which the membrane is operated from a decompression state to a compression state.

7. The method of claim 6, wherein the process (d) is performed such that the time point at which the membrane is operated from a decompression state to a compression state coincides with the time point at which the pressure chamber is converted from a contracted state to an expanded state.

8. The method of claim 1, further comprising:

(e) decompression-operating the membrane such that the volume of the pressure chamber becomes the initial value in concurrence with the time point at which the pressure chamber is converted from an expanded state to a contracted state, after the process (d).

9. The method of claim 8, further comprising stopping the operation of the membrane such that the volume of the pressure chamber is maintained, between the process (d) and the process (e).

10. The method of claim 1, wherein the time during which the membrane is compression- or decompression-operated is longer than the resonance period of the membrane.

11. The method of claim 1, further comprising:

(f) stopping the operation of the membrane such that the volume of the pressure chamber is maintained, between the process (a) and the process (b).

12. The method of claim 11, wherein the sum of the time consumed for the process (a) and the time consumed for the process (f) is equal to the time corresponding to one half of the resonance period.

13. The method of claim 1, further comprising stopping the operation of the membrane such that the volume of the pressure chamber is maintained, between the process (b) and the process (c).

14. The method of claim 1, wherein an actuator is joined to the membrane, and the compression- or decompression-operation of the membrane is performed by adjusting the value of the voltage delivered to the actuator.

15. A method of operating an inkjet head to eject an ink droplet, wherein the inkjet head comprises a pressure chamber, a membrane included in one side of the pressure chamber, and a nozzle connected to the pressure chamber and having a meniscus of an ink droplet formed therein, the meniscus being ejected and imbibed in a particular period, the method comprising:

(a) decompression-operating the membrane such that the volume of the pressure chamber is increased in correspondence with the period in which the meniscus is imbibed;

(b) compression-operating the membrane to eject a first ink droplet such that the volume of the pressure chamber is decreased in correspondence with the time point at which the meniscus is converted from an imbibe state to an eject state and a constructive interference is created;

(c) decompression-operating the membrane such that the volume of the pressure chamber is increased in correspondence with the period in which the meniscus is ejected; and (d) compression-operating the membrane to eject a second ink droplet such that the volume of the pressure chamber is decreased in correspondence with the time point at which the meniscus is converted from an eject state to an imbibe state and a destructive interference is created, wherein the second ink droplet is ejected slightly out of the nozzle and then imbibed back inside, such that the second ink droplet catches a tail portion of the first ink droplet and draws the tail portion inside the nozzle.

16. The method of claim 15, wherein the process (b) is performed such that the time point at which the meniscus is converted from an imbibe state to an eject state is included in the time duration in which the membrane is operated from a decompression state to a compression state.

17. The method of claim 16, wherein the process (b) is performed such that the time point at which the membrane is operated from a decompression state to a compression state coincides with the time point at which the meniscus is converted from an imbibe state to an eject state.

18. The method of claim 15, wherein the process (c) is performed such that the decompression-operation of the membrane is completed before the time point at which the meniscus is converted from an imbibe state to an eject state.

19. The method of claim 18, further comprising stopping the operation of the membrane such that the volume of the pressure chamber is maintained, between the process (c) and the process (d).

20. The method of claim 15, wherein the process (d) is performed such that the time point at which the meniscus is converted from an eject state to an imbibe state is included in the time duration in which the membrane is operated from a decompression state to a compression state.

21. The method of claim 20, wherein the process (d) is performed such that the time point at which the membrane is operated from a decompression state to a compression state coincides with the time point at which the meniscus is converted from an eject state to an imbibe state.

22. The method of claim 15, further comprising:

(e) decompression-operating the membrane such that the volume of the pressure chamber becomes the initial value in concurrence with the time point at which the meniscus is converted from an imbibe state to an eject state, after the process (d).

23. The method of claim 22, further comprising stopping the operation of the membrane such that the volume of the pressure chamber is maintained, between the process (d) and the process (e).

24. The method of claim 15, wherein the time during which the membrane is compression- or decompression-operated is longer than the resonance period of the membrane.

25. The method of claim 15, further comprising:

(f) stopping the operation of the membrane such that the volume of the pressure chamber is maintained, between the process (a) and the process (b).

26. The method of claim 25, wherein the sum of the time consumed for the process (a) and the time consumed for the process (f) is equal to the time corresponding to one half of the resonance period.

27. The method of claim 15, further comprising stopping the operation of the membrane such that the volume of the pressure chamber is maintained, between the process (b) and the process (c).

28. The method of claim 15, wherein an actuator is joined to the membrane, and the compression- or decompression-operation of the membrane is performed by adjusting the value of the voltage delivered to the actuator.

29. An inkjet recording device comprising:

a pressure chamber contracted and expanded in a particular period;

a membrane included in one side of the pressure chamber;

an actuator, joined to the membrane, for operating the membrane such that the membrane compresses or decompresses the pressure chamber;

a signal generation part for transmitting signals to the actuator; and a nozzle connected to the pressure chamber, wherein the signal generation part sequentially generates:

a first signal for decompression-operating the membrane such that the volume of the pressure chamber is increased in correspondence with the period in which the pressure chamber is expanded;

a second signal for compression-operating the membrane to eject a first ink droplet such that the volume of the pressure chamber is decreased in correspondence with the time point at which the pressure chamber is converted from an expanded state to a contracted state and a constructive interference is created;

a third signal for decompression-operating the membrane such that the volume of the pressure chamber is increased in correspondence with the period in which the pressure chamber is contracted; and a fourth signal for compression-operating the membrane to eject a second ink droplet such that the volume of the pressure chamber is decreased in correspondence with the time point at which the pressure chamber is converted from a contracted state to an expanded state and a destructive interference is created, wherein the second ink droplet is ejected slightly out of the nozzle and then imbibed back inside, such that the second ink droplet catches a tail portion of the first ink droplet and draws the tail portion inside the nozzle.

30. The inkjet recording device of claim 29, wherein the second signal is a signal for operating the membrane such that the time point at which the pressure chamber is converted from an expanded state to a contracted state is included in the time duration in which the membrane is operated from a decompression state to a compression state.

31. The inkjet recording device of claim 30, wherein the second signal is a signal for operating the membrane such that the time point at which the membrane is operated from a decompression state to a compression state coincides with the time point at which the pressure chamber is converted from an expanded state to a contracted state.

32. The inkjet recording device of claim 29, wherein the third signal is a signal for operating the membrane such that the decompression-operation of the membrane is completed before the time point at which the pressure chamber is converted from a contracted state to an expanded state.

33. The inkjet recording device of claim 32, wherein the signal generation part further generates a signal for operating the membrane such that the volume of the pressure chamber is maintained, between the third signal and the fourth signal.

34. The inkjet recording device of claim 29, wherein the fourth signal is a signal for operating the membrane such that the time point at which the pressure chamber is converted from a contracted state to an expanded state is included in the time duration in which the membrane is operated from a decompression state to a compression state.

35. The inkjet recording device of claim 34, wherein the fourth signal is a signal for operating the membrane such that the time point at which the membrane is operated from a decompression state to a compression state coincides with the time point at which the pressure chamber is converted from a contracted state to an expanded state.

36. The inkjet recording device of claim 29, wherein the signal generation part further generates a fifth signal for decompression-operating the membrane such that the volume of the pressure chamber becomes the initial value in concurrence with the time point at which the pressure chamber is converted from an expanded state to a contracted state, after the fourth signal.

37. The inkjet recording device of claim 36, wherein the signal generation part further generates a signal for operating the membrane such that the volume of the pressure chamber is maintained, between the fourth signal and the fifth signal.

38. The inkjet recording device of claim 29, wherein the time during which the membrane is compression- or decompression-operated is longer than the resonance period of the membrane.

39. The inkjet recording device of claim 29, wherein the signal generation part further generates a signal for operating the membrane such that the volume of the pressure chamber is maintained, between the first signal and the second signal.

40. The inkjet recording device of claim 29, wherein the signal generation part further generates a signal for operating the membrane such that the volume of the pressure chamber is maintained, between the second signal and the third signal.

41. The inkjet recording device of claim 29, wherein the first signal and the third signal have negative voltages, and the second signal and the fourth signal have positive voltages.

42. An inkjet recording device comprising:

a pressure chamber;

a membrane included in one side of the pressure chamber;

an actuator, joined to the membrane, for operating the membrane such that the membrane compresses or decompresses the pressure chamber;

a signal generation part for transmitting signals to the actuator; and a nozzle connected to the pressure chamber and having a meniscus of an ink droplet formed therein, the meniscus being ejected and imbibed in a particular period, wherein the signal generation part sequentially generates:

a first signal for decompression-operating the membrane such that the volume of the pressure chamber is increased in correspondence with the period in which the meniscus is imbibed;

a second signal for compression-operating the membrane to eject a first ink droplet such that the volume of the pressure chamber is decreased in correspondence with the time point at which the meniscus is converted from an imbibe state to an eject state and a constructive interference is created;

a third signal for decompression-operating the membrane such that the volume of the pressure chamber is increased in correspondence with the period in which the meniscus is ejected; and a fourth signal for compression-operating the membrane to eject a second ink droplet such that the volume of the pressure chamber is decreased in correspondence with the time point at which the meniscus is converted from an eject state to an imbibe state and a destructive interference is created, wherein the second ink droplet is ejected slightly out of the nozzle and then imbibed back inside, such that the second ink droplet catches a tail portion of the first ink droplet and draws the tail portion inside the nozzle.

43. The inkjet recording device of claim 42, wherein the second signal is a signal for operating the membrane such that the time point at which the meniscus is converted from an imbibe state to an eject state is included in the time duration in which the membrane is operated from a decompression state to a compression state.

44. The inkjet recording device of claim 43, wherein the second signal is a signal for operating the membrane such that the time point at which the membrane is operated from a decompression state to a compression state coincides with the time point at which the meniscus is converted from an imbibe state to an eject state.

45. The inkjet recording device of claim 42, wherein the third signal is a signal for operating the membrane such that the decompression-operation of the membrane is completed before the time point at which the meniscus is converted from an imbibe state to an eject state.

46. The inkjet recording device of claim 45, wherein the signal generation part further generates a signal for operating the membrane such that the volume of the pressure chamber is maintained, between the third signal and the fourth signal.

47. The inkjet recording device of claim 42, wherein the fourth signal is a signal for operating the membrane such that the time point at which the meniscus is converted from an eject state to an imbibe state is included in the time duration in which the membrane is operated from a decompression state to a compression state.

48. The inkjet recording device of claim 47, wherein the fourth signal is a signal for operating the membrane such that the time point at which the membrane is operated from a decompression state to a compression state coincides with the time point at which the meniscus is converted from an eject state to an imbibe state.

49. The inkjet recording device of claim 42, wherein the signal generation part further generates a fifth signal for decompression-operating the membrane such that the volume of the pressure chamber becomes the initial value in concurrence with the time point at which the meniscus is converted from an imbibe state to an eject state, after the fourth signal.

50. The inkjet recording device of claim 49, wherein the signal generation part further generates a signal for operating the membrane such that the volume of the pressure chamber is maintained, between the fourth signal and the fifth signal.

51. The inkjet recording device of claim 42, wherein the time during which the membrane is compression- or decompression-operated is longer than the resonance period of the membrane.

52. The inkjet recording device of claim 42, wherein the signal generation part further generates a signal for operating the membrane such that the volume of the pressure chamber is maintained, between the first signal and the second signal.

53. The inkjet recording device of claim 42, wherein the signal generation part further generates a signal for operating the membrane such that the volume of the pressure chamber is maintained, between the second signal and the third signal.

54. The inkjet recording device of claim 42, wherein the first signal and the third signal have negative voltages, and the second signal and the fourth signal have positive voltages.

55. A recorded medium readable by an inkjet recording device, tangibly embodying a program of instructions executable by the inkjet recording device for performing a method of operating an inkjet head comprising a pressure chamber that is contracted and expanded in a particular period, a membrane included in one side of the pressure chamber, and a nozzle connected to the pressure chamber, so as to perform printing by ejecting an ink droplet through the nozzle, the method comprising:

(a) generating and outputting a control signal for decompression-operating the membrane such that the volume of the pressure chamber is increased in correspondence with the period in which the pressure chamber is expanded;

(b) generating and outputting a control signal for compression-operating the membrane to eject a first ink droplet such that the volume of the pressure chamber is decreased in correspondence with the time point at which the pressure chamber is converted from an expanded state to a contracted state and a constructive interference is created;

(c) generating and outputting a control signal for decompression-operating the membrane such that the volume of the pressure chamber is increased in correspondence with the period in which the pressure chamber is contracted; and (d) generating and outputting a control signal for compression-operating the membrane to eject a second ink droplet such that the volume of the pressure chamber is decreased in correspondence with the time point at which the pressure chamber is converted from a contracted state to an expanded state and a destructive interference is created, wherein the second ink droplet is ejected slightly out of the nozzle and then imbibed back inside, such that the second ink droplet catches a tail portion of the first ink droplet and draws the tail portion inside the nozzle.

56. The recorded medium of claim 55, wherein the process (b) is performed such that the time point at which the membrane is operated from a decompression state to a compression state coincides with the time point at which the pressure chamber is converted from an expanded state to a contracted state.

57. The recorded medium of claim 55, wherein the process (c) is performed such that the decompression-operation of the membrane is completed before the time point at which the pressure chamber is converted from a contracted state to an expanded state.

58. The recorded medium of claim 57, wherein the method further comprises generating and outputting a control signal for stopping the operation of the membrane such that the volume of the pressure chamber is maintained, between the process (c) and the process (d).

59. The recorded medium of claim 55, wherein the process (d) is performed such that the time point at which the membrane is operated from a decompression state to a compression state coincides with the time point at which the pressure chamber is converted from a contracted state to an expanded state.

60. The recorded medium of claim 55, wherein the method further comprises:

(e) generating and outputting a control signal for decompression-operating the membrane such that the volume of the pressure chamber becomes the initial value in concurrence with the time point at which the pressure chamber is converted from an expanded state to a contracted state, after the process (d).

61. The recorded medium of claim 60, wherein the method further comprises generating and outputting a control signal for stopping the operation of the membrane such that the volume of the pressure chamber is maintained, between the process (d) and the process (e).

62. The recorded medium of claim 55, wherein the method further comprises generating and outputting a control signal for stopping the operation of the membrane such that the volume of the pressure chamber is maintained, between the process (a) and the process (b).

63. The recorded medium of claim 55, wherein the method further comprises generating and outputting a control signal for stopping the operation of the membrane such that the volume of the pressure chamber is maintained, between the process (b) and the process (c).

64. The recorded medium of claim 55, wherein an actuator is joined to the membrane, and the compression- or decompression-operation of the membrane is performed by adjusting the value of the voltage delivered to the actuator.

65. A recorded medium readable by an inkjet recording device, tangibly embodying a program of instructions executable by the inkjet recording device for performing a method of printing by operating an inkjet head comprising a pressure chamber, a membrane included in one side of the pressure chamber, and a nozzle connected to the pressure chamber and having a meniscus of an ink droplet formed therein, the meniscus being ejected and imbibed in a particular period, the method comprising:

(a) generating and outputting a control signal for decompression-operating the membrane such that the volume of the pressure chamber is increased in correspondence with the period in which the meniscus is imbibed;

(b) generating and outputting a control signal for compression-operating the membrane to eject a first ink droplet such that the volume of the pressure chamber is decreased in correspondence with the time point at which the meniscus is converted from an imbibe state to an eject state and a constructive interference is created;

(c) generating and outputting a control signal for decompression-operating the membrane such that the volume of the pressure chamber is increased in correspondence with the period in which the meniscus is ejected; and (d) generating and outputting a control signal for compression-operating the membrane to eject a second ink droplet such that the volume of the pressure chamber is decreased in correspondence with the time point at which the meniscus is converted from an eject state to an imbibe state and a destructive interference is created, wherein the second ink droplet is ejected slightly out of the nozzle and then imbibed back inside, such that the second ink droplet catches a tail portion of the first ink droplet and draws the tail portion inside the nozzle.

66. The recorded medium of claim 65, wherein the process (b) is performed such that the time point at which the membrane is operated from a decompression state to a compression state coincides with the time point at which the meniscus is converted from an imbibe state to an eject state.

67. The recorded medium of claim 65, wherein the process (c) is performed such that the decompression-operation of the membrane is completed before the time point at which the meniscus is converted from an imbibe state to an eject state.

68. The recorded medium of claim 67, wherein the method further comprises generating and outputting a control signal for stopping the operation of the membrane such that the volume of the pressure chamber is maintained, between the process (c) and the process (d).

69. The recorded medium of claim 65, wherein the process (d) is performed such that the time point at which the membrane is operated from a decompression state to a compression state coincides with the time point at which the meniscus is converted from an eject state to an imbibe state.

70. The recorded medium of claim 65, wherein the method further comprises:

(e) generating and outputting a control signal for decompression-operating the membrane such that the volume of the pressure chamber becomes the initial value in concurrence with the time point at which the meniscus is converted from an imbibe state to an eject state, after the process (d).

71. The recorded medium of claim 70, wherein the method further comprises generating and outputting a control signal for stopping the operation of the membrane such that the volume of the pressure chamber is maintained, between the process (d) and the process (e).

72. The recorded medium of claim 65, wherein the method further comprises generating and outputting a control signal for stopping the operation of the membrane such that the volume of the pressure chamber is maintained, between the process (a) and the process (b).

73. The recorded medium of claim 65, wherein the method further comprises generating and outputting a control signal for stopping the operation of the membrane such that the volume of the pressure chamber is maintained, between the process (b) and the process (c).

74. The recorded medium of claim 65, wherein an actuator is joined to the membrane, and the compression- or decompression-operation of the membrane is performed by adjusting the value of the voltage delivered to the actuator.

* * * * *